US011511903B2

(12) United States Patent
Franke et al.

(10) Patent No.: US 11,511,903 B2
(45) Date of Patent: Nov. 29, 2022

(54) APPARATUS, SYSTEM AND METHOD FOR OPENING AND UNPACKING

(71) Applicant: Groninger & Co. GmbH, Crailsheim (DE)

(72) Inventors: Bernd Franke, Wallhausen (DE); Josef Veile, Westhausen (DE)

(73) Assignee: GRONINGER & CO. GMBH, Crailsheim (DE)

( * ) Notice: Subject to any disclaimer, the term of this patent is extended or adjusted under 35 U.S.C. 154(b) by 336 days.

(21) Appl. No.: 16/697,830

(22) Filed: Nov. 27, 2019

(65) Prior Publication Data

US 2020/0172280 A1 Jun. 4, 2020

(30) Foreign Application Priority Data

Nov. 29, 2018 (DE) ..... 10 2018 130 356.4

(51) Int. Cl.
*B65B 69/00* (2006.01)

(52) U.S. Cl.
CPC ..... *B65B 69/0008* (2013.01); *B65B 69/0033* (2013.01); *B65B 69/0058* (2013.01)

(58) Field of Classification Search
CPC ..... B65B 69/0033; B65B 69/0008; B65B 69/0058; B65B 31/04; B65B 31/041; B65B 31/042; B65B 31/043; B65B 31/003; B65B 21/08; B65B 41/02; B65B 43/42; B65D 77/003
USPC ..... 414/412
See application file for complete search history.

(56) References Cited

U.S. PATENT DOCUMENTS 4,107,905 A * 8/1978 Grocke ..... B65B 21/08 53/492
2015/0314903 A1* 11/2015 Aya ..... B65B 69/0008 414/412
2017/0158369 A1 6/2017 Dopfer et al.
2020/0122870 A1* 4/2020 Wapinsky ..... B65B 43/52

FOREIGN PATENT DOCUMENTS

DE 102007027878 A1 12/2008
DE 102011080289 A1 2/2013
DE 102014201961 A1 8/2015
DE 102014201967 A1 8/2015
(Continued)

OTHER PUBLICATIONS

Office Action Issued by the German Patent Office for application 10 2018 130 356.4 dated Jul. 10, 2019.
(Continued)

*Primary Examiner* — Glenn F Myers
(74) *Attorney, Agent, or Firm* — Reising Ethington, P.C.

(57) ABSTRACT

An apparatus for opening a packaging in which a transport tub for objects is packaged, the packaging having a packaging portion which extends in an extent direction away from the transport tub, the apparatus having a cutting-open device for cutting open the packaging in order to generate an opening in the packaging, the cutting-open device being designed to cut off a first part of the packaging portion in order to generate the opening in the packaging, and having an inflating device for inflating the packaging through the opening generated in the packaging. The apparatus furthermore relates to a system for opening a packaging, and to a method.

25 Claims, 14 Drawing Sheets

(56) References Cited

FOREIGN PATENT DOCUMENTS

| | | | | |
|---|---|---|---|---|
| EP | 1837280 | A1 | | 9/2007 |
| JP | H02296634 | A | | 12/1990 |
| JP | 03085238 | A | * | 4/1991 |

OTHER PUBLICATIONS

English Translation of Office Action Issued by the German Patent Office for application 10 2018 130 356.4 dated Jul. 10, 2019.
EP Search Report for Application No. 19211937.8 dated May 19, 2020 (7 pages).
English Translation of EP Search Report for Application No. 19211937.8 dated May 19, 2020 (7 pages).

* cited by examiner

APPARATUS, SYSTEM AND METHOD FOR OPENING AND UNPACKING

CROSS-REFERENCE TO RELATED APPLICATION

This application claims the priority of German patent application DE 10 2018 130 356.4, filed on Nov. 29, 2018, the entire content of which is herein incorporated by reference.

TECHNICAL FIELD

The present application relates to an apparatus and a method for opening a packaging in which a transport tub for objects is packaged, in particular vacuum-packaged, the packaging having a packaging portion which extends in an extent direction away from the transport tub. The present application furthermore relates to a system for unpacking a transport tub for objects from a packaging in which the transport tub is packaged, having the apparatus for opening the packaging. The present application furthermore relates to a method for unpacking a transport tub for objects from a packaging in which the transport tub is packaged.

BACKGROUND

Document DE 10 2007 027 878 A1 presents an apparatus for removing a sterile article from a sterile packaging, comprising a clamping device which clamps a first partial region of the sterile packaging, a cutting apparatus for cutting open the sterile packaging such that a slot is generated in the sterile packaging, a holding device which holds a second partial region of the sterile packaging, and a removal device for removing the article from the sterile packaging through the slot. A method for removing a sterile article is also presented.

Furthermore, the document DE 10 2011 080 289 A1 presents an apparatus for removing a sterile article from a foil bag, comprising a needle unit with a hollow needle for piercing the foil bag, a gas connector on the needle unit for injecting gas via the needle into the foil bag, a cutting apparatus for cutting open the foil bag, a holding device for holding the foil bag, and a removal device for removing the article from the foil bag.

In the case of packaged objects, in particular in the case of vacuum-packaged objects, there is basically the problem of how to suitably unpack these. In the case of packaging units which have a tight fold or adverse friction characteristics of the material partners, the surfaces of the bag can be separated from the surfaces of the transport tub or of the tub only with difficulty during the removal process. In other words, the individual parts are bonded together or adhere to one another. In particular if a vacuum prevails in the packaging, the removal of the object from the packaging is impeded because the packaging adheres to the object owing to the static friction. To solve this problem, the prior art proposes piercing the packaging by means of a needle and allowing gas to flow into the packaging through the needle in order to inflate the packaging, whereby the packaging separates from the object and easy removal is made possible. Here, however, the object must be designed so as not to be damaged during the piercing by the needle. In particular, the object has a cavity into which the needle can pierce.

SUMMARY

It is an object of the present application to provide an improved apparatus and an improved method for opening a packaging, in particular a vacuum packaging. There is furthermore a demand for an improved system and an improved method for removing a transport tub from a packaging in which the transport tub is packaged, in particular vacuum-packaged.

According to a first aspect, therefore, an apparatus for opening a packaging in which a transport tub for objects is packaged, in particular vacuum-packaged, is proposed. The packaging has a packaging portion which extends in an extent direction away from the transport tub. The apparatus has a cutting-open device for cutting open a packaging in order to generate an opening in the packaging, and has an inflating device for inflating the packaging through the opening generated in the packaging. The cutting-open device is designed to cut off a first part of the packaging portion in order to generate the opening in the packaging.

According to a second aspect, a method for opening a packaging in which a transport tub for objects is packaged, in particular vacuum-packaged, is proposed. The method has the following steps:

- provision of the packaged transport tub, the packaging having a packaging portion which extends in an extent direction away from the transport tub;
- cutting-open of the packaging by means of a cutting-open device in order to generate an opening in the packaging, the cutting-open device cutting off a first part of the packaging portion in order to generate the opening in the packaging; and
- inflation of the packaging by means of an inflating device through the opening generated in the packaging.

According to a third aspect, a system for unpacking a transport tub for objects from a packaging in which the transport tub is packaged, having the apparatus according to the first aspect, is proposed.

According to a fourth aspect, a method for unpacking a transport tub for objects from a packaging in which the transport tub is packaged, in particular vacuum-packaged, is proposed. The method has the following steps:

- opening of the packaging in accordance with the method according to the second aspect; and
- removal of the transport tub from the packaging by means of a removal device and/or pushing-out of the transport tub from the packaging by means of a pushing means.

The expression "transport tub" is to be understood in particular to mean an over-packaging for objects. This over-packaging may be designed for example as a rack, tablet or tray. The transport tub has a receptacle for a multiplicity of objects. The transport tub may also have one or more receptacles for in each case one or more objects. These receptacles may be designed for example as depressions or apertures into which one or more objects can be inserted and in which the objects are preferably held.

The objects may be pharmaceutical or cosmetic objects. The objects may for example be containers for pharmaceutical or cosmetic liquids. In particular, the objects may be syringes or vials.

The packaging portion of the packaging may for example be in the form of a tab which protrudes from the packaging. Such a tab forms in particular in the region of weld seams during the packaging of the transport tub in the packaging. In particular in the case of vacuum packaging, such a tab forms in the region of the weld seam through which the vacuum was generated prior to the welding. The packaging portion extends in the extent direction away from the transport tub.

The packaging may for example be in the form of a foil bag. The transport tub can be arranged and packaged or vacuum-packaged in the foil bag. As a result of the vacuum-packaging, the foil bag lies fully against the transport tub. In particular, no cavities are provided or necessary between the transport tub and the foil bag. For example, the foil bag can be in the form of a tubular bag which is welded at the front side and at the rear side. The protruding packaging portion is in this case arranged preferably at the front side.

The protruding packaging portion may for example be of tubular form such that the opening of the packaging is generated in the packaging portion. The protruding packaging portion may be formed in particular as a tubular foil layer. In other words, the protruding packaging portion has in this case a foil layer running in encircling fashion perpendicular to the extent direction. Preferably, the tubular foil layer has, in the first part of the packaging portion, in particular at the protruding end of the packaging portion, a weld seam running substantially perpendicular to the extent direction. The interior of the packaging and the interior of the packaging portion are connected to one another. In other words, the tubular foil layer transitions integrally into the packaging at the front side of the transport tub.

By means of the proposed apparatus and the proposed method for opening the packaging, the packaging is opened such that the packaging does not remain adhered to the transport tub after the opening process. Easy removal is thus made possible.

Furthermore, the apparatus and the method for opening are independent of the design of the transport tub. In particular, there is no need to provide, in the transport tub, a cavity into which a needle can be introduced for the purposes of piercing and inflating. In this way, the method and the apparatus are considerably simplified, and there is also no risk of the transport tub, or the objects arranged in the transport tub, being able to be damaged as a result of the piercing process.

Furthermore, the apparatus makes it possible for the cutting-open and inflation to be performed in combined fashion using one apparatus. In this way, the opening process of the packaging is accelerated, and furthermore, less structural space is required. In other words, a space-saving construction and faster process implementation are thereby made possible.

In a first refinement, provision may be made whereby the packaging portion is arranged at a side of the transport tub, such that the opening is generated on said side of the transport tub.

Preferably, the packaged transport tub may, for the opening process, be arranged on a transport plane of a transport device. With respect to the transport plane, the transport tub has a bottom side, which is directed toward the transport plane, and an oppositely arranged top side. Between the top side and the bottom side, there are arranged peripheral sides. In particular, the packaging portion is arranged at the peripheral side.

In a further refinement, provision may be made whereby the packaging portion has a second part which is arranged between the first part and the rest of the packaging, a cut generated during the cutting-off of the first part of the packaging portion running between the first part and the second part.

In this refinement, the first part of the packaging portion is cut off completely, while the second part of the packaging portion remains on the packaging. The opening that has been made is therefore situated at that side of the second part of the packaging portion at which the cut runs between the first part and the second part of the packaging portion. Thus, the packaging is inflated through the second part of the packaging portion. Piercing into the packaging is thus avoided.

In a further refinement, provision may be made whereby the cut runs over the entire width of the packaging portion, the width of the packaging portion extending perpendicular to the extent direction, a cut direction of the cut in particular running perpendicular to the extent direction.

In this refinement, the opening is generated over the entire width of the packaging portion. In other words, the width of the opening corresponds to the width of the packaging portion. The width of the opening is thus in particular at least as wide as a width of the transport tub. The removal of the transport tub is thus further simplified.

In a further refinement, provision may be made whereby the apparatus has a holding device for holding a second part of the packaging portion, the first part and the second part in particular differing from one another.

As a result of the second part of the packaging portion being held, both the cutting-open of the packaging and the inflation of the packaging can be optimized. In particular, the packaging portion does not move during the inflation and during the cutting-open, such that these two steps can be performed more precisely and more quickly.

In a further refinement, provision may be made whereby the holding device has a first clamping element and a second clamping element for clamping the second part of the packaging portion, the first clamping element and the second clamping element being movable relative to one another.

Here, the clamping is performed by means of a relative movement of the clamping elements toward one another. Furthermore, the clamping elements can be moved away from one another such that a gap forms between the clamping elements, into which gap the packaging portion can firstly be inserted or arranged such that it can subsequently be clamped between the two clamping elements.

In a further refinement, provision may be made whereby adhesion means are provided on that side of each clamping element which faces toward the packaging portion, which adhesion means are designed to adhere to the second part of the packaging portion, in particular to draw the second part of the packaging portion onto them by suction.

In this way, the second packaging part remains adhered to the clamping elements during and after the clamping, such that, in the event of a relative movement of the clamping elements away from one another, the opening of the packaging is enlarged, in particular widened.

In a further refinement, provision may be made whereby the holding device is furthermore designed to clamp the second part of the packaging portion during the cutting-open of the packaging and/or during the inflation of the packaging.

In this way, during the cutting-open, the second part of the packaging portion is held, whereby the cut generated during the cutting-open can be made more precisely. Furthermore, by means of the clamping during the inflation, the opening is partially closed, such that less gas can escape to the outside from the opening of the packaging during the inflation, thus improving the inflation process.

In a further refinement, provision may be made whereby the holding device is furthermore designed to open, in particular widen, the opening before the inflation of the packaging and/or after the inflation of the packaging.

As a result of the opening of the opening before the inflation, means for inflating can be more easily inserted into the opening of the packaging. As a result of the opening, in particular widening, of the opening after the inflation, subsequent process steps, such as for example a removal of the transport tub from the packaging, are likewise facilitated. Preferably, in the case of the opening of the opening before the inflation of the packaging, the opening is opened only to such an extent that the means for inflating can be inserted into the opening of the packaging. It is furthermore preferable if, after the inflation of the packaging, the opening is opened further, in particular is opened to such an extent that the larger opening corresponds at least to the dimensions of the transport tub.

In a further refinement, provision may be made whereby the inflating device has a blowing nozzle which, in order to inflate the packaging, can be inserted into the packaging through the opening of the packaging.

In other words, the blowing nozzle is a means for inflating the packaging. A blowing nozzle may preferably be connected to a gas pressure device which allows a predefined quantity of gas at a predefined pressure to flow through the blowing nozzle. Pressure and gas quantity may in this case be selected such that the packaging is inflated to an adequately great extent but does not burst.

In a further refinement, provision may be made whereby the holding device is furthermore designed to clamp the second part of the packaging portion and the blowing nozzle during the inflation of the packaging.

It is achieved in this way that the opening of the packaging, which is arranged at the second part of the packaging portion, is completely closed as a result of the clamping and, on the other hand, the blowing nozzle is arranged in the opening, such that firstly an inflation of the packaging is made possible and secondly an escape of gas from the packaging during the inflation can be avoided. The inflation process is further optimized in this way.

In a further refinement, provision may be made whereby the first clamping element and/or the second clamping element has a recess for the blowing nozzle, the recess in particular being filled with an elastic material.

By means of this refinement, the inflation process and the clamping during the inflation process are further optimized, because, owing to the refinement of the clamping elements with a recess, the gas nozzle can be arranged optimally between the first and the second clamping element during the inflation.

In a further refinement, provision may be made whereby the apparatus furthermore has a fixing device, the fixing device being designed to fix the packaging and the transport tub during the cutting-open and/or during the inflation.

By means of the fixing of the packaging and of the transport tub during the individual process steps of the cutting-open and of the inflation, the individual process steps can be performed in a more effective and more exact manner, without the packaging or the transport tub undesirably slipping or being repositioned.

In a further refinement, provision may be made whereby the fixing device is furthermore designed to likewise open, in particular widen, the opening after the inflation of the packaging.

It is achieved in this way that the fixing device assists the opening in addition to the holding device, such that the packaging is more effectively separated from the transport tub and thus a removal of the transport tub from the packaging is further simplified.

In a further refinement, provision may be made whereby the apparatus furthermore has a pushing means which is designed to push out the transport tub from the packaging after the opening of the packaging.

In this way, a simple means is provided for unpacking the transport tub from the packaging.

Alternatively or in addition, in a further refinement, provision may be made whereby the system furthermore has a removal device for removing the transport tub from the opened packaging.

The removal device may for example have a gripper or suction device designed to remove the transport tub from the packaging through the opening.

In a further refinement, provision may be made whereby the system furthermore has a transport device for transporting in the packaged transport tub and/or for transporting out the unpacked transport tub.

The transport device may for example have a transport plane on which the transport tub is transported. The transport tub may preferably be arranged on the transport plane during the cutting-open and the inflation of the packaging.

In a further refinement, provision may be made whereby the method furthermore has the following step:

insertion of a blowing nozzle of the inflating device into the packaging through the opening of the packaging.

In other words, the blowing nozzle is a means for inflating the packaging. A blowing nozzle may preferably be connected to a gas pressure device which allows a predefined quantity of gas at a predefined pressure to flow through the blowing nozzle. Pressure and gas quantity may in this case be selected such that the packaging is inflated to an adequately great extent but does not burst.

In a further refinement, provision may be made whereby the method furthermore has the following step:

first clamping of a second part of the packaging portion by means of a holding device at least during the cutting-off.

In this way, during the cutting-open, the second part of the packaging portion is held, whereby the cut generated during the cutting-open can be made more precisely. The first clamping is preferably performed before and during the cutting-off.

In a further refinement, provision may be made whereby the method furthermore has the following step:

first opening of the opening of the packaging by means of a holding device after the cutting-off and before the inflation, in particular before the insertion.

By means of the opening of the opening before the inflation, means for inflating can be more easily inserted into the opening of the packaging. Preferably, during the opening of the opening before the inflation of the packaging, the opening is opened only to such an extent that the means for inflating can be inserted into the opening of the packaging.

In a further refinement, provision may be made whereby the method furthermore has the following step:

second clamping of a second part of the packaging portion by means of a holding device at least during the inflation.

In this way, by means of the clamping during the inflation, the opening is partially closed, such that less gas can escape to the outside from the opening of the packaging during the inflation, thus improving the inflation process. The second clamping is preferably performed after the first opening, in particular after the insertion. The second clamping is preferably performed before and during the inflation. In particular, in the step of the second clamping, the second part of the packaging portion, and the blowing nozzle inserted into said packaging portion, are jointly clamped.

In a further refinement, provision may be made whereby the method furthermore has the following step:

second opening of the opening of the packaging by means of a holding device after the inflation.

By means of the opening, in particular widening, of the opening after the inflation, subsequent process steps, such as for example a removal of the transport tub from the packaging, are likewise facilitated. It is preferable if, after the inflation of the packaging, the opening is opened further, in particular is opened to such an extent that the larger opening corresponds at least to the dimensions of the transport tub.

It is self-evident that the features mentioned above and the features yet to be discussed below may be used not only in the respectively specified combination but also in other combinations or individually without departing from the scope of the present invention.

BRIEF DESCRIPTION OF THE SEVERAL VIEWS OF THE DRAWING

Embodiments of the invention are illustrated in the drawing and will be discussed in more detail in the following description, in which.

DETAILED DESCRIPTION

Figure 1:
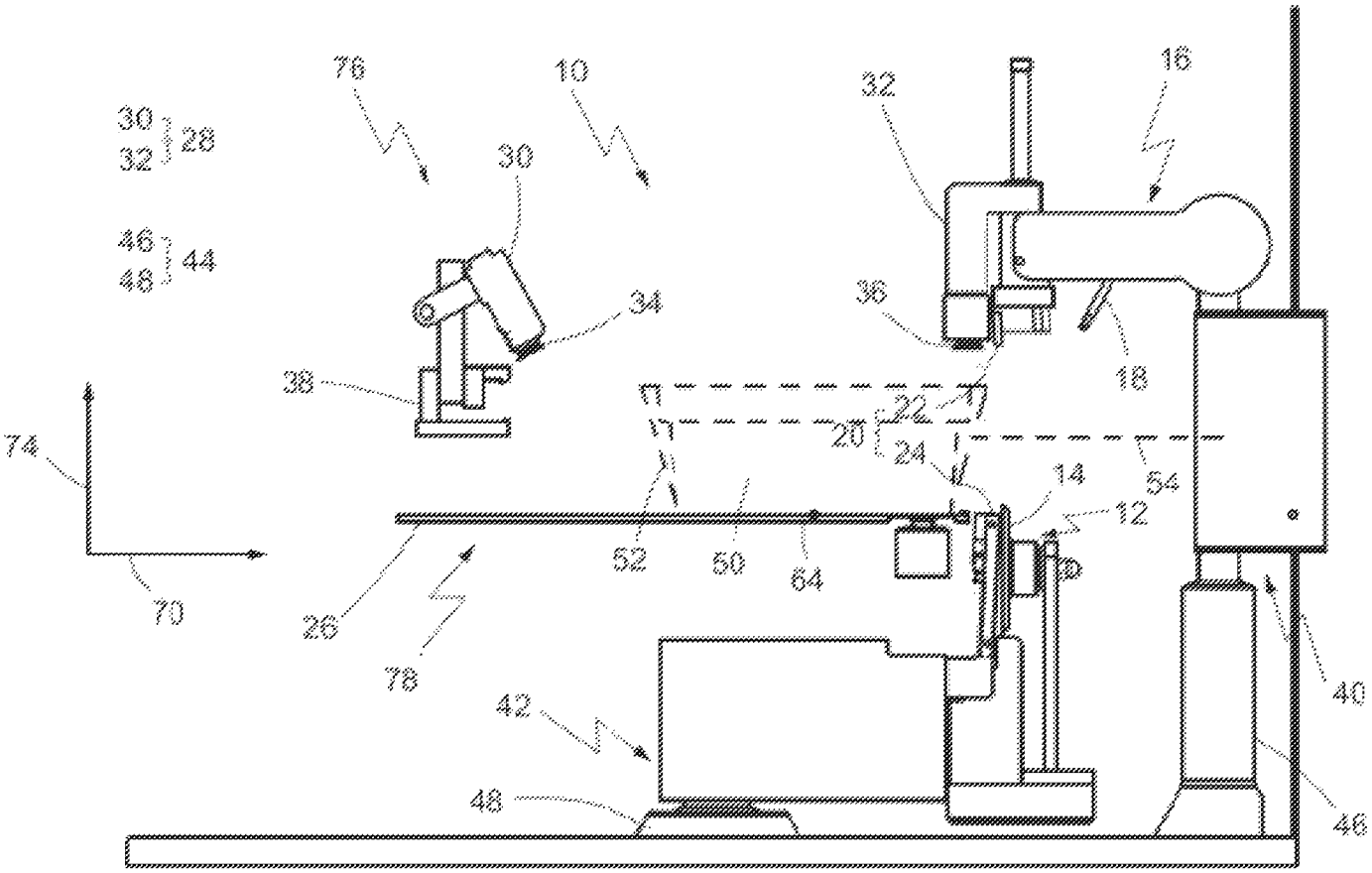
FIG. 1 shows a side view of an embodiment of an apparatus for opening a packaging.
Figures 3A, 3B:
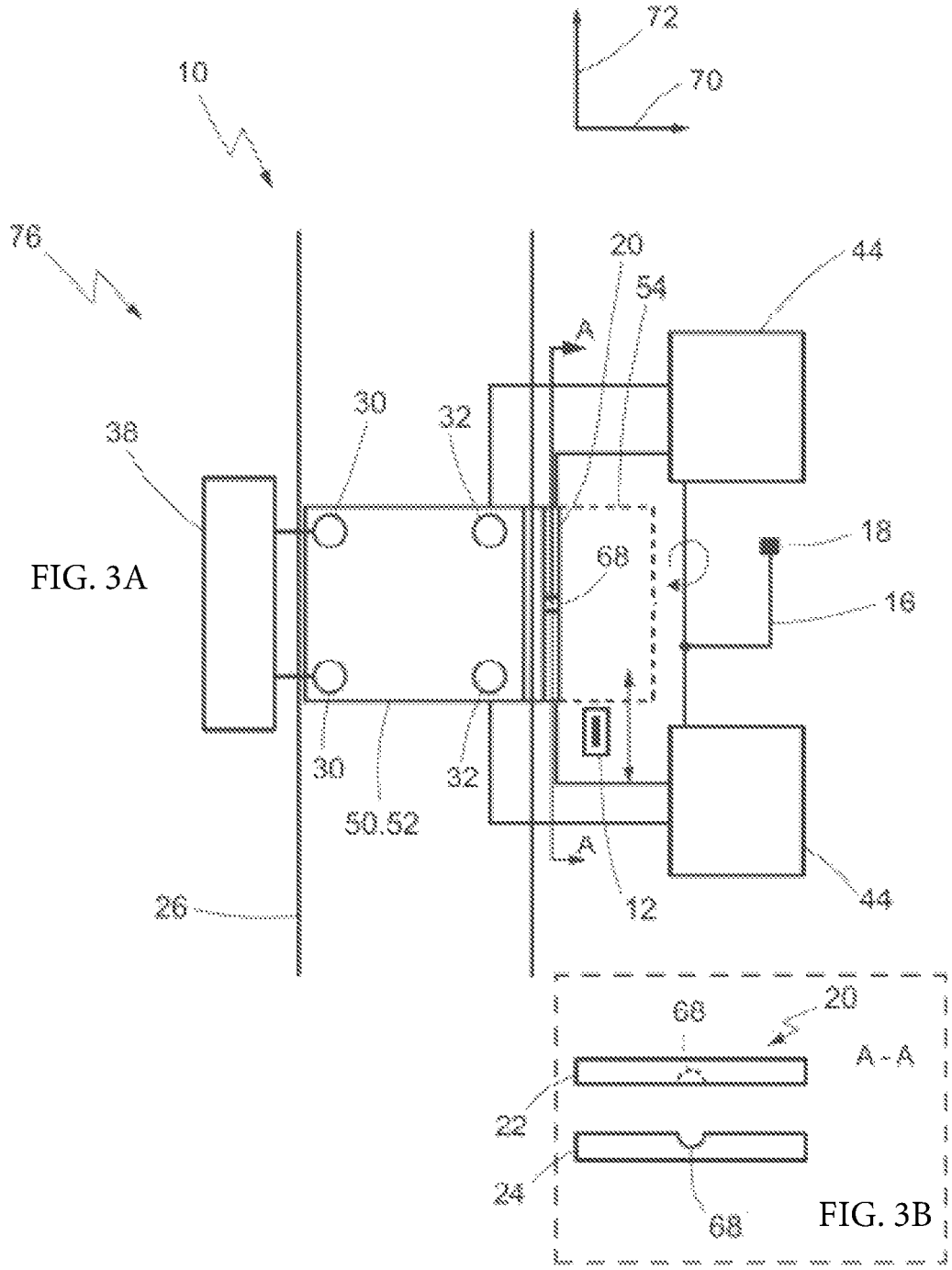
FIG. 3A shows a schematic plan view of the apparatus for opening a packaging from FIG. 1.
FIG. 3B shows a section of FIG. 3A along the line A-A.

FIGS. 1 and 3A show an embodiment of an apparatus 10 for opening a packaging 52 in which a transport tub 50 for objects is vacuum-packaged. The apparatus 10 may be part of a system 76 for unpacking the transport tub 50 from the packaging 52.

In FIG. 1, the packaging 52 and the transport tub 50 are illustrated using dashed lines in order to illustrate that the apparatus 10 is designed to open the packaging 52, and the packaging 52 and the transport tub 50 can be arranged in the form illustrated by dashed lines.

Figure 2:
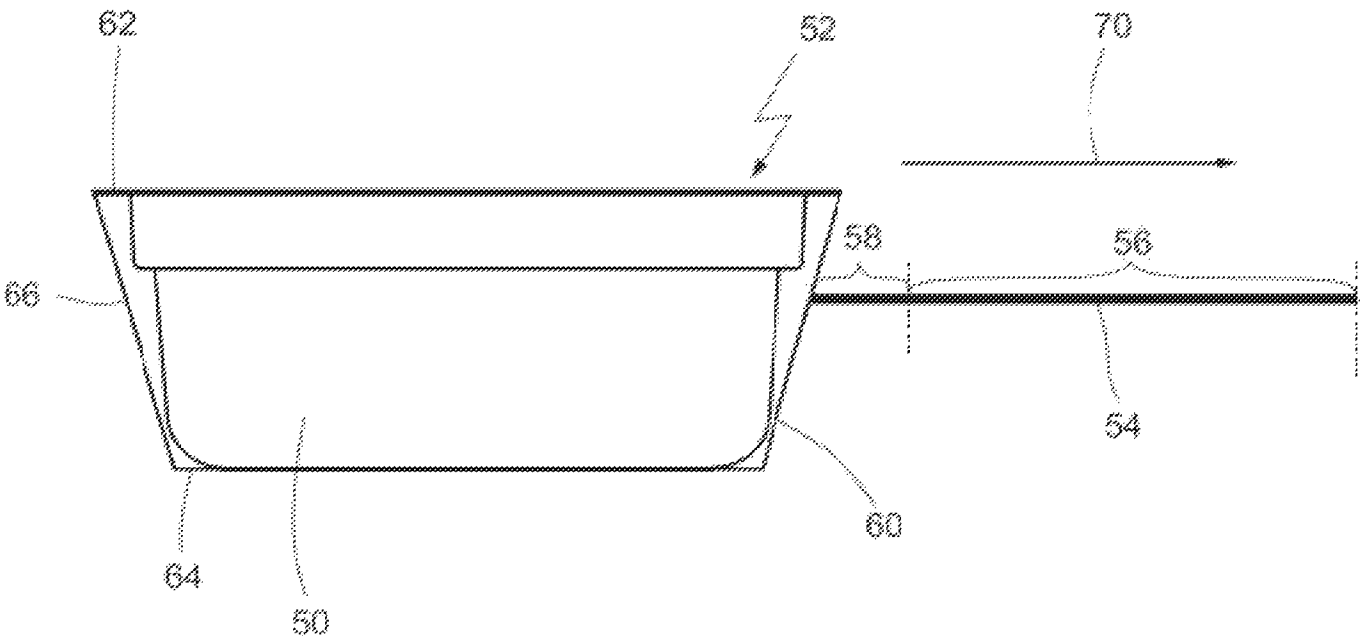
FIG. 2 shows a side view of a transport tub vacuum-packaged in a packaging.

An exemplary embodiment of the transport tub 50 and of the packaging 52 is illustrated in FIG. 2. In said figure, the transport tub 50 is arranged in the packaging 52. The packaging 52 may be in the form of a foil bag. The packaging 52 has a packaging portion 54 which extends in an extent direction 70 away from the transport tub 50. The packaging portion 54 is preferably in the form of a tab which protrudes from the packaging 52. The packaging portion 54 is divided into two parts, specifically a first part 56 and a second part 58. The second part is arranged between the packaging 52 and the first part 56. The tab is in particular in the form of a tubular foil layer which has a weld seam for sealing the packaging 52 in the first part 56 of the packaging portion 54.

The transport tub 50 furthermore has a front side 60, a top side 62, a rear side 66, and a bottom side 64. Between the top side 62 and the bottom side 64, the transport tub 50 has a peripheral surface which also includes the front side 60 and the rear side 66. The front side 60 and the rear side 66 are arranged opposite one another in the extent direction 70. The top side 62 is arranged opposite the bottom side 64. The packaging portion 54 is arranged at the front side 60 of the transport tub 50. Alternatively, the packaging portion 54 may however also be arranged at any other point of the peripheral surface, of the top side 62 or of the bottom side 64 of the transport tub 50.

The embodiment of FIG. 1 may furthermore have a transport device 78 for transporting in the vacuum-packaged transport tub 50 and/or for transporting out the unpacked transport tub 50. The transport device 78 may for example have a transport plane 26 for this purpose. The bottom side 64 of the transport tub 50 may face toward the transport plane 26. The transport tub 50 preferably lies with the bottom side 64 on the transport plane 26. In particular, the extent direction 70 runs substantially parallel to the transport plane 26. The transport device 78 may be part of the system 76.

Furthermore, the apparatus 10 has a cutting-open device 12. The cutting-open device 12 may be arranged adjacent to the transport plane 26 in the extent direction 70. The cutting-open device 12 is designed to cut open the packaging 52 in order to generate an opening 130 in the packaging 52. In particular, the cutting-open device 12 is designed to cut off the first part 56 of the packaging portion 54 in order to generate the opening 130 in the packaging 52. During the cutting-off of the first part 56 of the packaging portion 54, a cut is generated between the first part 56 and the second part 58 of the packaging portion 54. In other words, the generated cut runs between the first part 56 and the second part 58 in a cut direction 72. In particular, the cut direction 72 of the cut runs perpendicular to the extent direction 70. The cut preferably runs over the entire width of the packaging portion 54. The width of the packaging portion 54 extends perpendicular to the extent direction 70.

The cutting-open device 12 has, for the cutting-off, a cutting blade 14 by means of which the first part 56 of the packaging portion 54 can be cut off in order to cut open the packaging 52. Alternatively or in addition, the cutting-open device 12 may also have other means for cutting off or cutting open the packaging, for example an optical cutting tool, in particular a laser.

Furthermore, the apparatus 10 has an inflating device 16 for inflating the packaging 52 through the opening 130 generated in the packaging 52. For this purpose, the inflating device 16 preferably has a blowing nozzle 18. The blowing nozzle 18 is arranged such that, in order to inflate the packaging 52, it can be inserted into the packaging 52 through the opening 130 of the packaging 52. For this purpose, provision may be made whereby the blowing nozzle 18 is arranged pivotably above the packaging portion 54, such that the blowing nozzle 18 can, for the inflation process, be pivoted into the opening 130.

The apparatus 10 furthermore has a holding device 20 for holding the second part 58 of the packaging portion 54. For this purpose, the holding device 20 may have a first clamping element 22 and a second clamping element 24 for clamping the second part 58 of the packaging portion 54. Here, provision may be made in particular whereby the first clamping element 22 and the second clamping element 24 are movable relative to one another. Adhesion means may be provided on that side of the respective clamping element 22, 24 which faces toward the packaging portion 54, which adhesion means are designed to adhere to the second part 58 of the packaging portion 54, in particular to draw the second part 58 of the packaging portion 54 onto them by suction. In other words, those sides of the clamping elements 22, 24 which face toward the packaging portion 54 are arranged opposite one another, wherein the packaging portion 54 is clamped between said sides.

Correspondingly, the packaging portion 54 has a first side 132 and a second side 134. The first side 132 faces toward the first clamping element, and the second side 134 faces toward the second clamping element 24. In the case of the clamping of the second part 58 of the packaging portion 54, the first clamping element 22 bears against the first side 132 and the second clamping element 24 bears against the second side 134. This is illustrated in more detail in particular in FIGS. 7, 9, 11 and 13. Likewise, when the clamping elements 22, 24 adhere to the sides 132, 134 of the packaging portion 54, the first clamping element 22 bears against the first side 132 and the second clamping element 24 bears against the second side 134. In this way, it is made possible that, when the clamping elements 22, 24 adhere to the sides 132, 134 of the packaging portion 54, a size of the opening 130 can be varied by means of a relative movement of the clamping elements 22, 24.

The clamping elements 22, 24 may for example be in the form of clamping strips. Preferably, a width of the clamping strips extending perpendicular to the extent direction 70 corresponds at least to a width of the packaging portion 54, wherein said width of the packaging portion 54 extends in the same direction, likewise perpendicular to the extent direction.

The holding device 20 may furthermore have a suction device (not illustrated) which interacts with the clamping elements 22, 24. For example, the clamping elements 22, 24 may, along the width, have holes through which the suction device can draw the packaging portion 54 onto it by suction. The holes are preferably spaced apart from one another equidistantly along the width. In other words, the suction device and the holes provide possible adhesion means for the holding device 20, wherein, by said means, the sides 132, 134 adhere to the clamping elements 22, 24.

Provision may furthermore be made whereby the first clamping element 22 and/or the second clamping element 24 has a recess 68 for the blowing nozzle 18. Here, it is for example possible for the recess 68 to be filled with an elastic material. The recess 68 in the first clamping element 22 and/or in the second clamping element 24 may in particular be of complementary shape with respect to the shape of the blowing nozzle 18. It is thus achieved that the holding device 20 can fully clamp the packaging portion 54 while the blowing nozzle 18 is inserted into the opening 130 without gas being able to escape to the outside from the opening 130.

The apparatus 10 may furthermore have a fixing device 28. The fixing device 28 may have a first fixing element 30 and a second fixing element 32. The first fixing element 30 has a first suction head 34. The second fixing element 32 has a second suction head 36. The first fixing element 30 is arranged at the rear side 66 of the transport tub 50 and above the transport tub. The second fixing element 32 is arranged at the front side 60 of the transport tub 50 and above the transport tub 50. The first fixing element 30 is mounted on a holder so as to be pivotable about an axis which runs parallel to the transport plane 26 and perpendicular to the extent direction 70. The holder of the first fixing element 30 is movable in the extent direction 70. The second fixing element 32 is movable perpendicularly with respect to the transport plane 26.

Furthermore, the apparatus 10 has a pushing means 38. The pushing means is arranged on the rear side 66 of the transport tub 50. The pushing means 38 is movable in a pushing direction 136 in order to push out the transport tub 50 from the packaging 52 after the opening of the packaging 52. The pushing direction 136 may preferably correspond to the extent direction 70. The pushing-out by way of the pushing means 38 is illustrated in more detail in FIG. 14. The pushing means 38 may be formed integrally with the holder for the first fixing element 30.

Furthermore, alternatively or in addition to the pushing means 38, a removal device may also be provided which is designed to remove the transport tub 50 from the opened packaging 52. The removal device may in particular be part of the system 76.

The apparatus 10 may furthermore have at least one drive device which is designed to move the first clamping element 22 and the second clamping element 24 relative to one another in a lifting direction 74. For example, for this purpose, the apparatus 10 may have a first drive device 40, which moves the first clamping element 22 in the lifting direction 74, and a second drive device 42 may be provided, which moves the second clamping element 24 in the lifting direction 74.

Furthermore, the apparatus 10 may have a carrier device 44 which carries the holding device 20, the cutting-open device 12 and the inflating device 16. The carrier device 44 may have the first drive device 40 and the second drive device 42. The carrier device 44 preferably has a first carrier element 46 and a second carrier element 48. For this purpose, the first carrier element 46 may be designed to carry the inflating device 16. The second carrier element 48 may be designed to carry the cutting-open device 12. In particular, provision may be made whereby the first carrier element 46 furthermore carries the first clamping element 22. Here, the first carrier element may likewise have the first drive device 40 in order to move the first clamping element 22 in the lifting direction 74. The first carrier element 46 may furthermore also carry the second fixing element 32. In this way, the movements of the first clamping element 22 in the lifting direction 74 and of the second fixing element 32 in the lifting direction 74 may be coupled to one another.

Furthermore, the second carrier element 48 may likewise also carry the second clamping element 24. Here, provision may also be made whereby the second carrier element 48 has the second drive device 42 in order to move the second clamping element 24 in the lifting direction 74. Here, provision may be made in particular whereby the second drive device 42 moves both the second clamping element 24 and the cutting-open device 12 together in the lifting direction 74. In this way, it is thus possible by means of the first and second drive devices 40, 42 for both the relative position of the first and of the second clamping element 22, 24, and the positioning of the cutting-open device 12 and of the inflating device 16 relative to the packaging portion 54 and the opening 130 to be generated therein, to be adjusted.

FIG. 3A shows a schematic plan view of the apparatus 10 from FIG. 1. Said figure illustrates the relative positioning of the individual components of the apparatus 10 in the direction perpendicular to the extent direction 70 and perpendicular to the lifting direction 74. The cutting blade 24 of the cutting-open device 12 is movable in a cutting direction 72 which runs in particular perpendicularly with respect to the extent direction 70. In this way, during the cutting-open, the cut is generated between the first part 56 and the second part 58 of the packaging portion 54 in the cutting direction 72. Before and after the cutting-open, the cutting blade 14 is arranged adjacent to the packaging portion 54 in the cutting direction 72.

Furthermore, two first fixing elements 30 and two second fixing elements 32 may be provided in order to fix the packaging 52 and the transport tub 50 during the opening and unpacking. These may be arranged on opposite sides on the top side 62 of the transport tub 50.

Furthermore, the carrier device 44 may also be arranged on both sides adjacent to the packaging portion 54. In particular, the carrier device 44 may have components on opposite sides, in the cutting direction 72, of the packaging portion 54. Here, components of the first carrier element 46 and/or of the second carrier element 48 are preferably also arranged on said opposite sides of the packaging portion 54.

Furthermore, the inflating device 16 with the blowing nozzle 18 is mounted on the carrier device so as to be pivotable, in particular about an axis parallel to the cutting direction 72 and/or perpendicular to the extent direction 70. In this way, the blowing nozzle 18 can be inserted, in particular pivoted, into the opening 130 of the packaging 52. Alternatively or in addition, other means for inserting the blowing nozzle 18 into the opening 130 may also be provided. For example, the blowing nozzle 18 may also be pushed into the opening 130 by means of a pushing device.

FIG. 3B describes the embodiment of the clamping elements 22, 24 in more detail. Here, FIG. 3*b* shows in particular a section through the clamping elements 22, 24 perpendicular to the extent direction 70. As described above, the first clamping element 22 and/or the second clamping element 24 may have the recess 68. Preferably, the recess 68 in the first clamping element 22 and/or in the second clamping element 24 is of complementary shape with respect to the blowing nozzle 18, such that the blowing nozzle 18 can be received in the recess 68 during the clamping.

Figure 4:
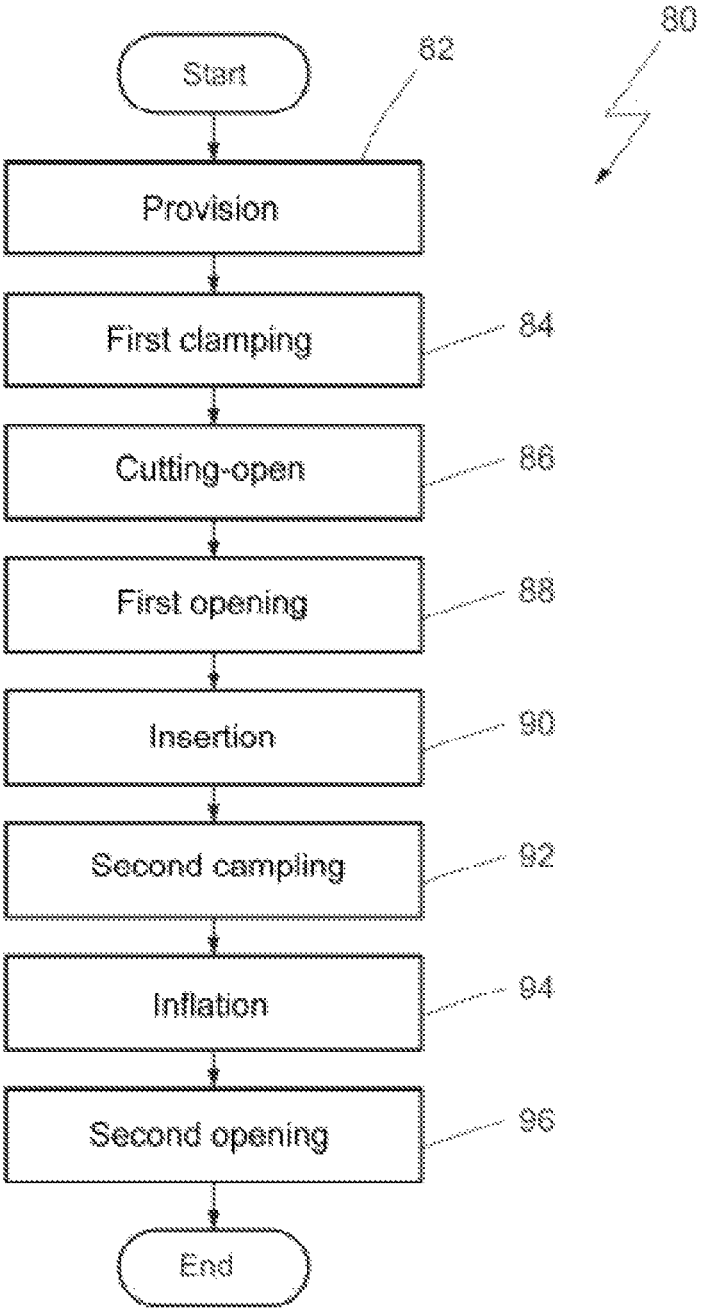
FIG. 4 is a schematic illustration of an embodiment of a method for opening a packaging.

FIG. 4 shows an embodiment of a method 80 for opening a packaging 52 in which a transport tub 50 of an object is vacuum-packaged. The method can be carried out by means of the apparatus 10 described in FIGS. 1 to 3.

In a first step 82 of the method 80, the vacuum-packaged transport tub 50 is provided. Here, the packaging 52 has, as already illustrated in FIG. 2, a packaging portion 54 which extends in the extent direction 70 away from the transport tub 50.

In a further optional step 84 of the method 80, the second part 58 of the packaging portion 54 is clamped for a first time by means of the holding device 20, at least during the cutting-off 86 that will be described below.

Provision may furthermore be made whereby, in the step of the first clamping 84 or in the step of the provision 82, the packaging 52 and the transport tub 50 are fixed by means of the fixing device 28.

In a further step 86 of the method 80, the packaging 52 is cut open by means of the cutting-open device 12 in order to generate an opening in the packaging. Here, the cutting-open device 12 cuts off the first part 56 of the packaging portion 54 in order to generate the opening 130 in the packaging 52.

In a further optional step 88 of the method 80, the opening of the packaging is opened for a first time by means of the holding device 20 after the step of the cutting-off 86 and before the step of inflation 94 that will be described below. The step of the first opening 88 is performed in particular before the step of the insertion 90 that will be described below.

In a further optional step 90 of the method 80, a blowing nozzle 18 of the inflating device 16 is inserted into the packaging 52 through the opening 130 of the packaging 52.

In a further optional step 92 of the method 80, the second part of the packaging portion 54 is clamped for a second time by means of the holding device 20, at least during the subsequent step of the inflation 94. Here, provision may in particular be made whereby the holding device 20 clamps both the second part 58 of the packaging portion 54 and the blowing nozzle 18 during the inflation of the packaging 52. In this regard, reference is made in particular to the embodiments of the clamping elements described in FIG. 3B by means of the recess 68, which permit this clamping in a preferred manner.

In a further step 94 of the method 80, the packaging 52 is inflated by means of the inflating device 16 through the opening 130 generated in the packaging 52.

In a further optional step 96 of the method 80, the opening 130 of the packaging 52 is opened for a second time by means of the holding device 20 after the inflation 94.

Figure 5:
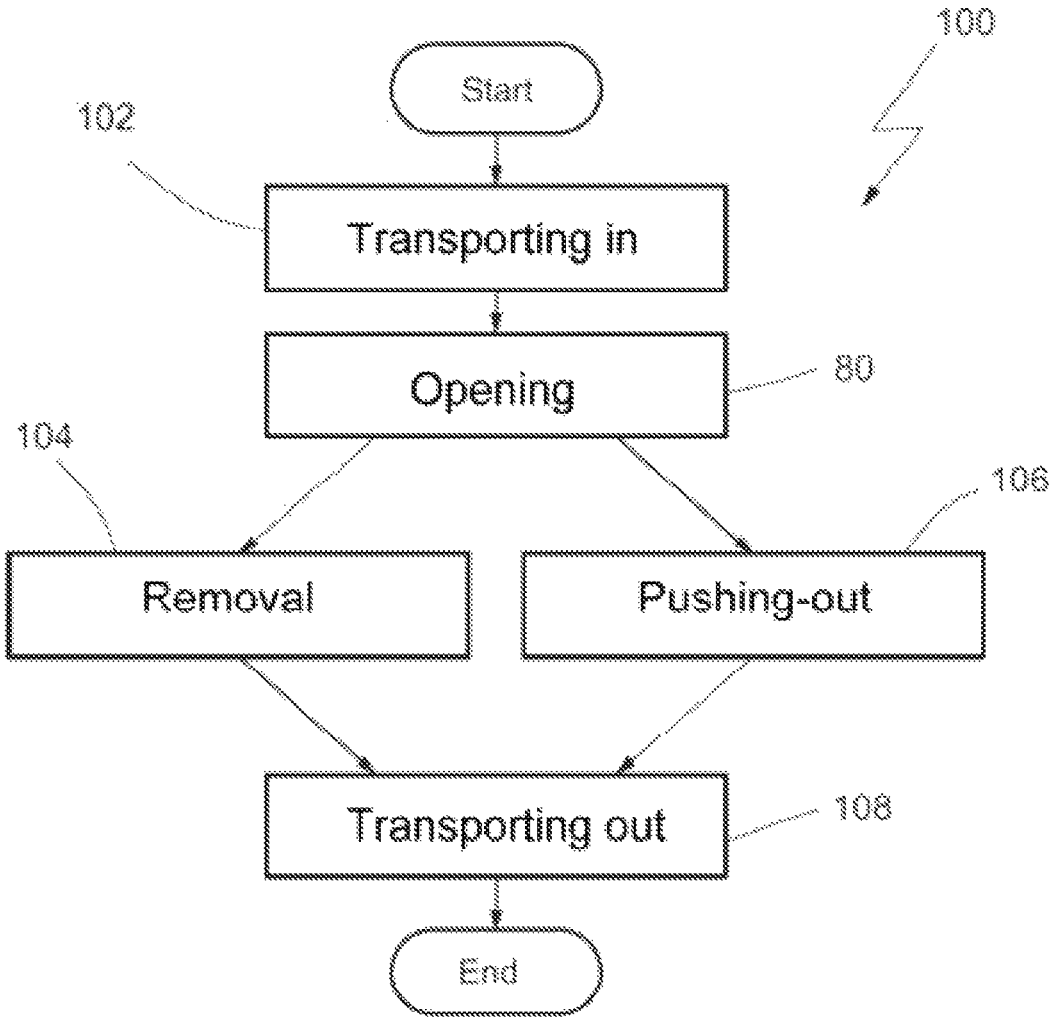
FIG. 5 is a schematic illustration of an embodiment of a method for unpacking a transport tub.

FIG. 5 shows an embodiment of a method 100 for unpacking a transport tub 50 for objects from a packaging 52 in which the transport tub 50 is vacuum-packaged. The method 100 can be performed by means of the system 76 for unpacking. The method 100 has the steps described below.

In a first optional step 102 of the method 100, the vacuum-packaged transport tub 50 is transported in by means of a transport device 78.

In a further step 80 of the method 100, the packaging 52 is opened in accordance with the method 80 described in FIG. 4.

In a further step 104 of the method 100, the transport tub 50 is removed from the packaging 52 by means of a removal device.

In an alternative or additional step 106 of the method 100, provision may be made whereby the transport tub 50 is pushed out of the packaging 52 by means of a pushing means 38.

In a further optional step 108 of the method 100, the unpacked transport tub 50 is transported out by means of the transport device 78.

FIGS. 6 to 14 illustrate the apparatus 10 in individual method states of the methods 80 for opening and of the method 100 for unpacking.

Figure 6:
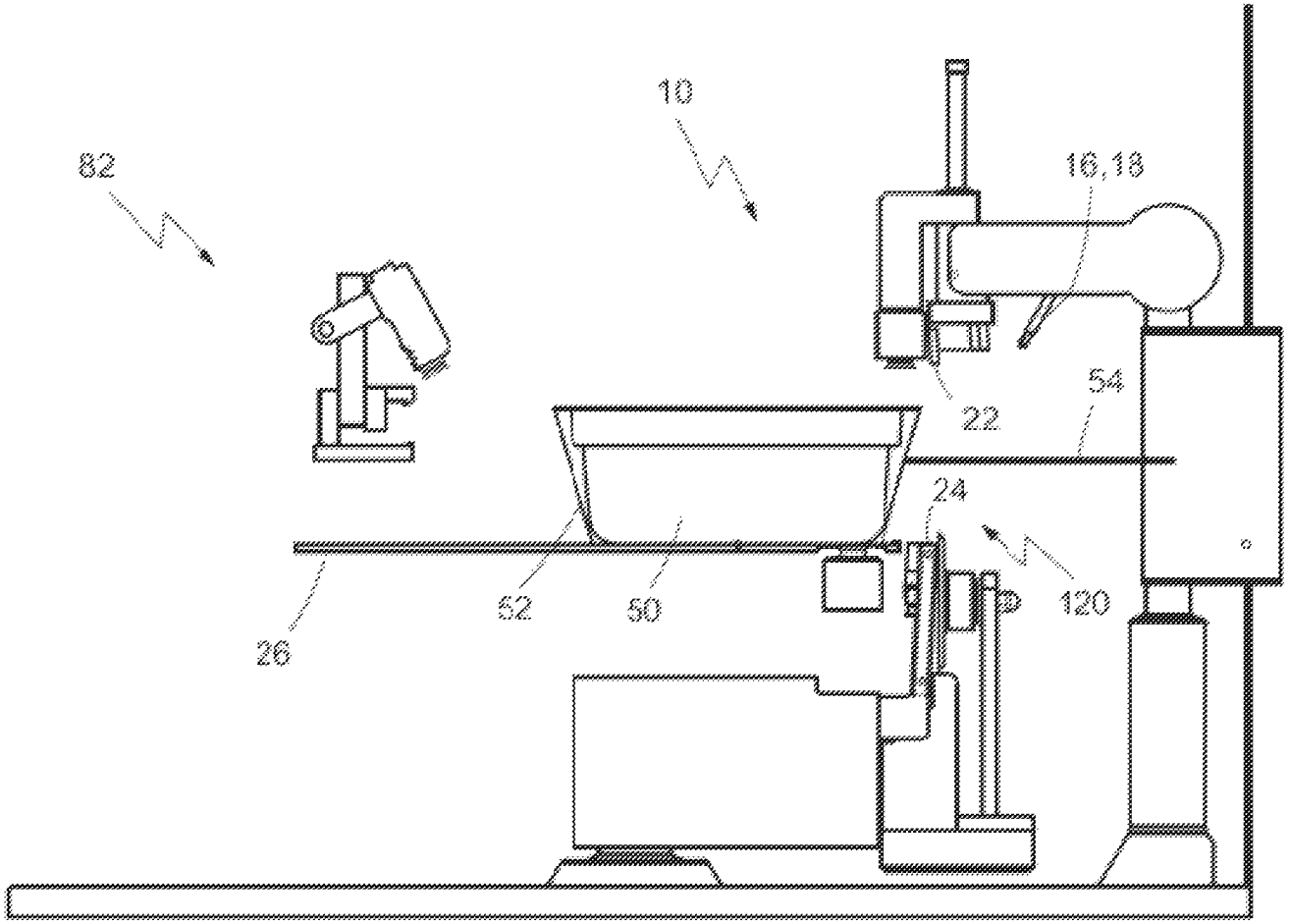
FIG. 6 shows a side view of the apparatus for opening a packaging from FIG. 1 in the step of the provision.

FIG. 6 illustrates the apparatus 10 in the state of the step of the provision 82 of the method 80. In said state, the transport tub 50 and the packaging 52 are arranged on the transport plane 26. The clamping elements 22 and 24 of the holding device 20 are arranged in a first position 120 relative to one another. The spacing of the clamping elements 22, 24 in the first position 120 is greater than a height of the packaging 52 in a direction perpendicular to the transport plane 26. The packaging portion 54 extends from the packaging 52 through between the clamping elements 22 and 24 in the extent direction 70.

Figure 7:
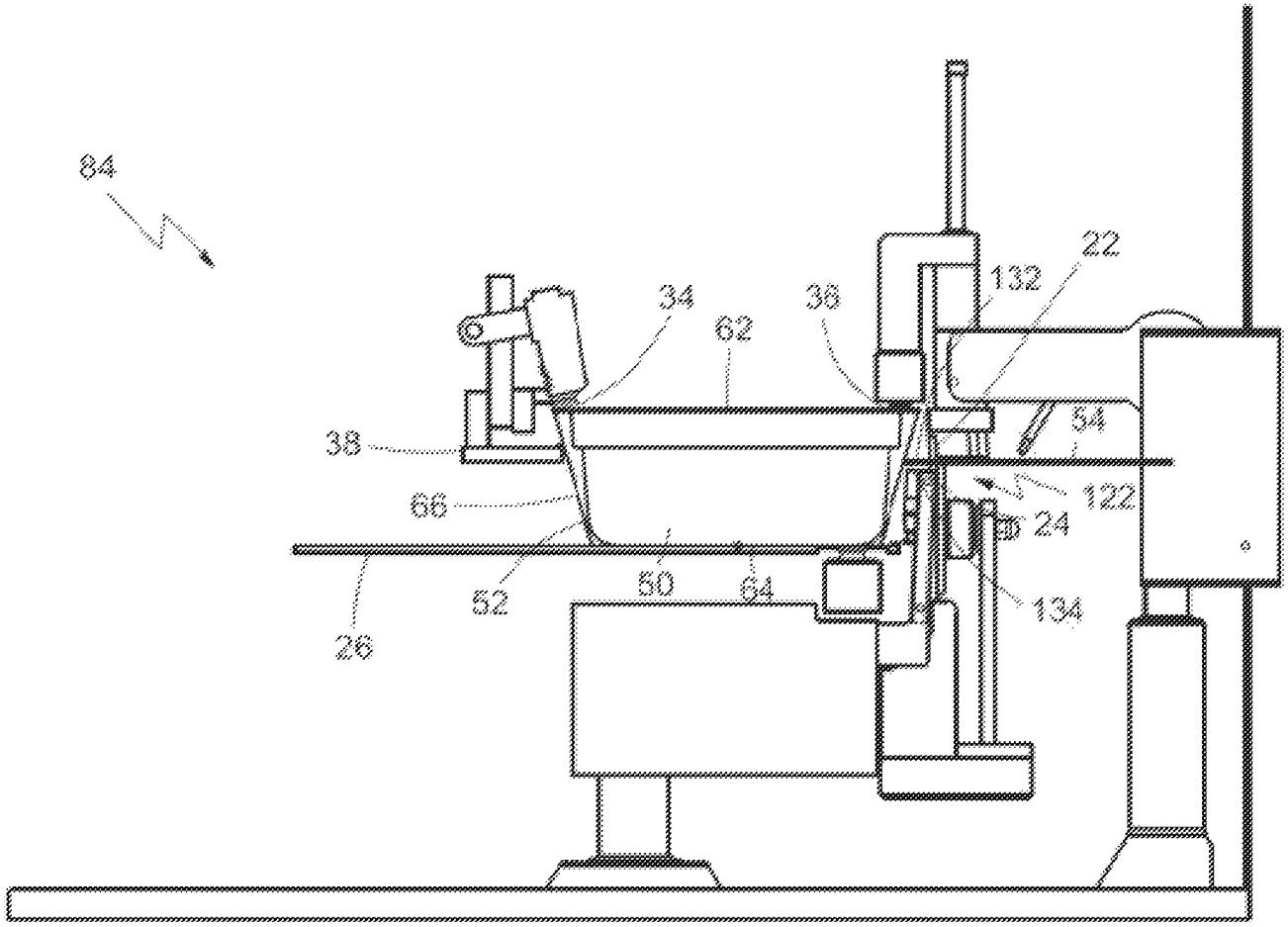
FIG. 7 shows a side view of the apparatus for opening a packaging from FIG. 1 in the step of the first clamping.

FIG. 7 illustrates the apparatus 10 in the state of the step of the first clamping 84 of the method 80. In said state, the first and the second clamping element 22, 24 are arranged in a second position 122, in which the two clamping elements 22, 24 are clamped on the packaging portion 54 in the second part 58. In particular, the first clamping element 22 bears against the first side 132 of the packaging portion 54 and the second clamping element 24 bears against the second side 134 of the packaging portion 54. Furthermore, the fixing device 30 fixes the packaging 52 and the transport tub 50 by means of the suction heads 34 and 36.

Figure 8:
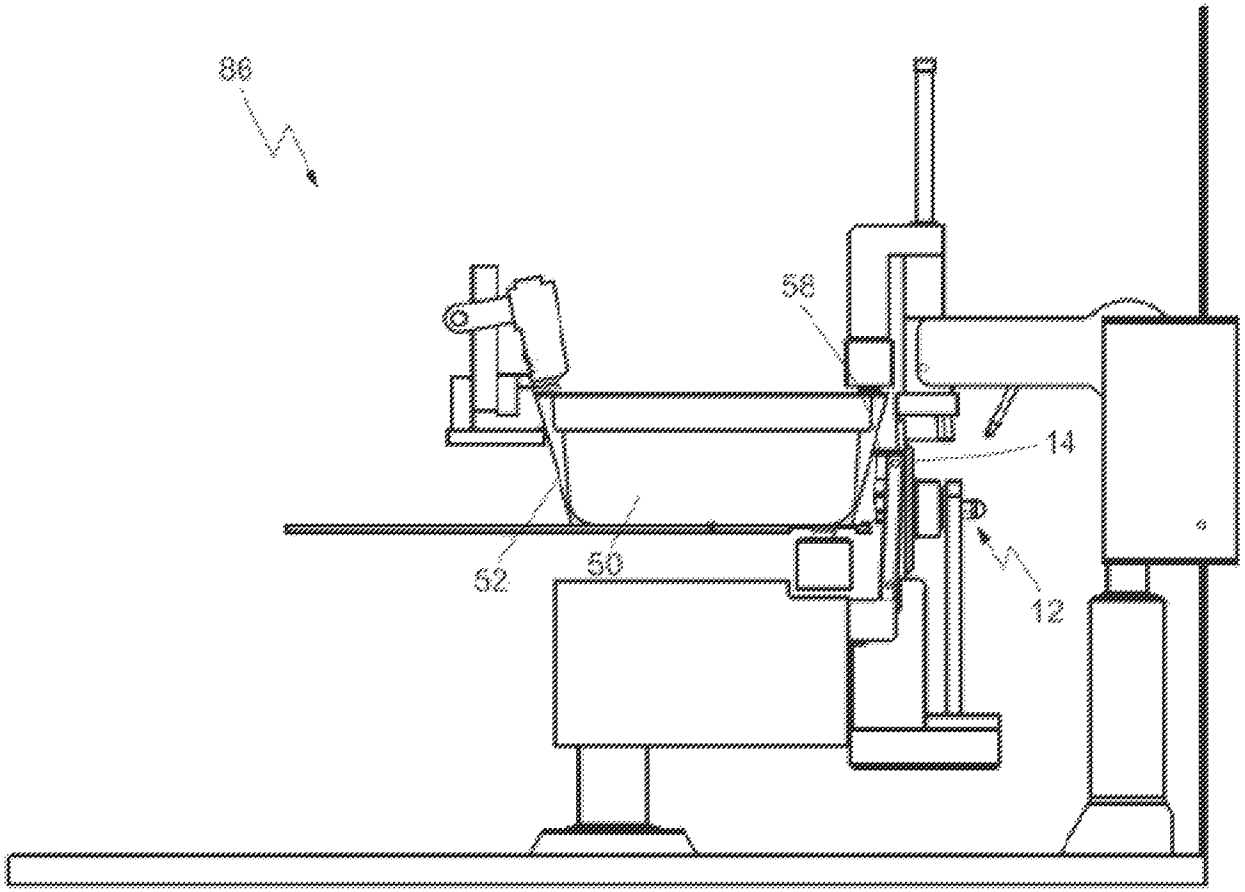
FIG. 8 shows a side view of the apparatus for opening a packaging from FIG. 1 in the step of the cutting-open.

FIG. 8 illustrates the apparatus 10 in the state of the step of the cutting-open 86 of the method 80. Here, the first part 56 of the packaging portion 54 has been cut off by means of the cutting blade 14 of the cutting-open device 12. The packaging 52 thus only has the second part 58 of the packaging portion 54 left. As a result of the cutting-open 86, the opening 130 is generated at the outer end of the second part 58 of the packaging portion 54.

Figure 9:
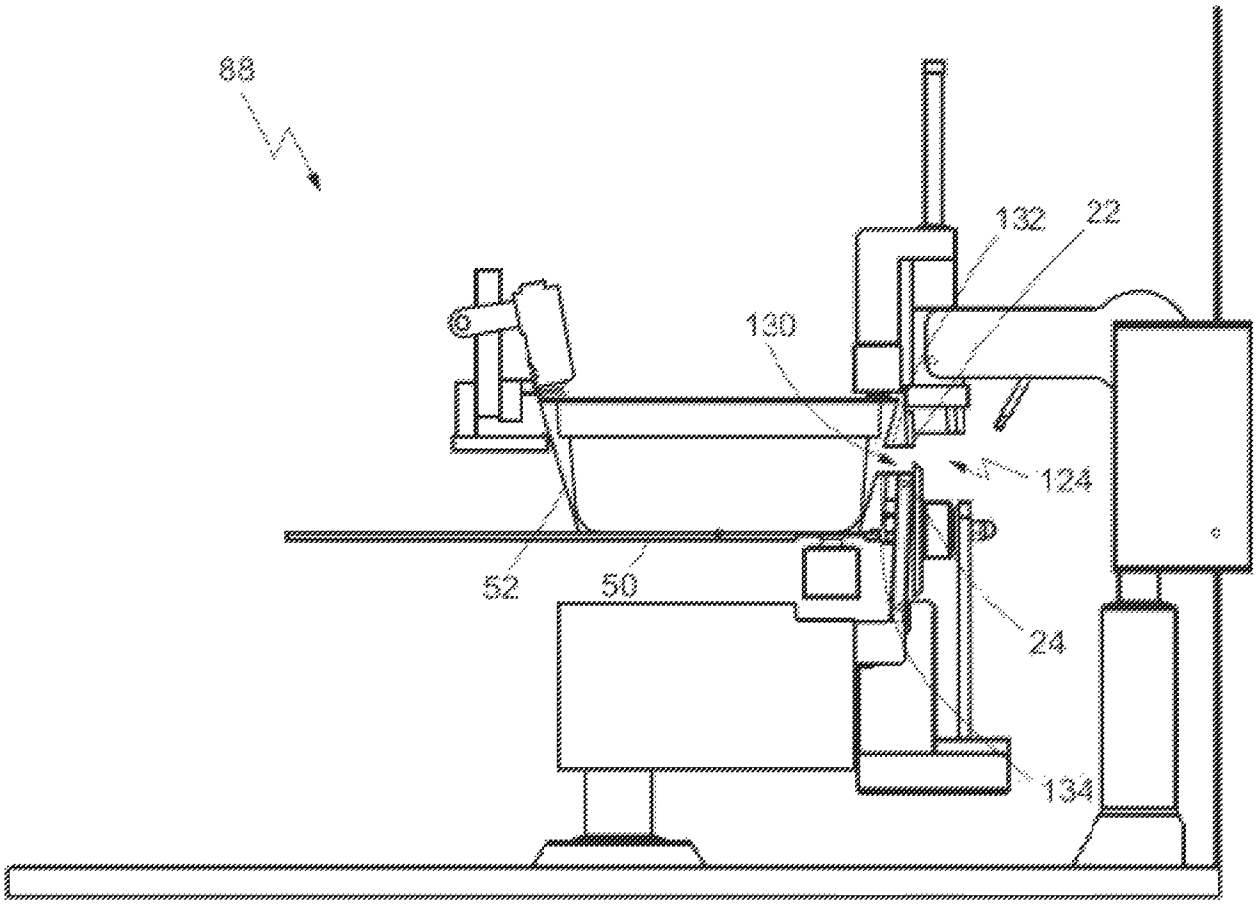
FIG. 9 shows a side view of the apparatus for opening a packaging from FIG. 1 in the step of the first opening.

FIG. 9 illustrates the apparatus 10 in the state of the step of the first opening 88 of the method 80. In this step, the two clamping elements 22, 24 are arranged in a third position 124 relative to one another. The position 124 is selected such that the opening 130 is opened, in particular enlarged or widened. Here, the first side 132 adheres to the first clamping element 22 and the second side 134 adheres to the second clamping element 24. The opening 130 is in this case preferably enlarged only to such an extent that the blowing nozzle 18 of the inflating device 16 can be inserted into the opening 130.

Figure 10:
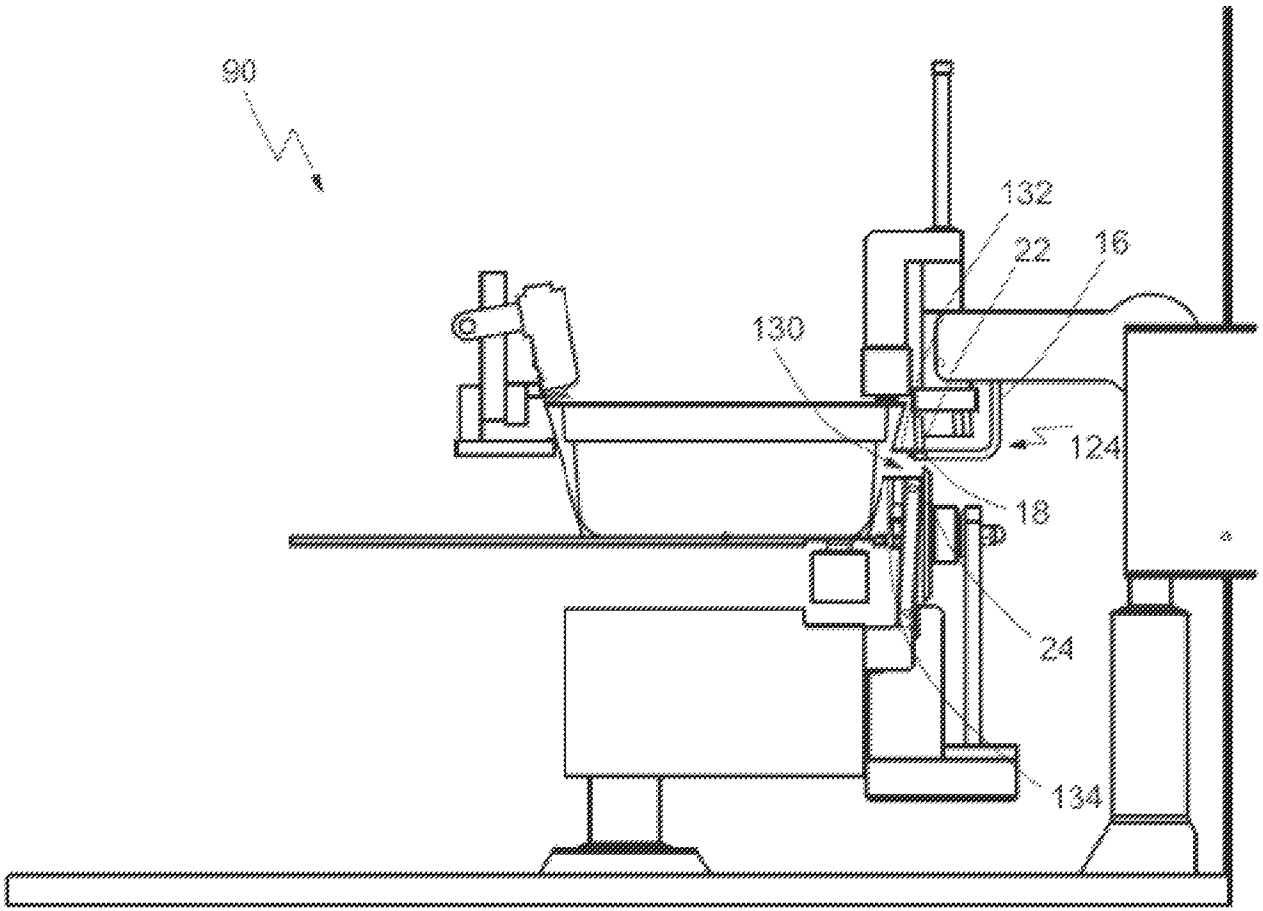
FIG. 10 shows a side view of the apparatus for opening a packaging from FIG. 1 in the step of the insertion.

FIG. 10 illustrates the apparatus 10 in the state of the step of the insertion 90 of the method 80. The clamping elements 22 and 24 are arranged in the third position 124. The size of the opening 130 therefore corresponds to the opening from FIG. 9. The blowing nozzle 18 of the inflating device 16 has been inserted into the opening 130. The blowing nozzle 18 is in this case preferably pivoted and/or pushed into the opening 130.

Figure 11:
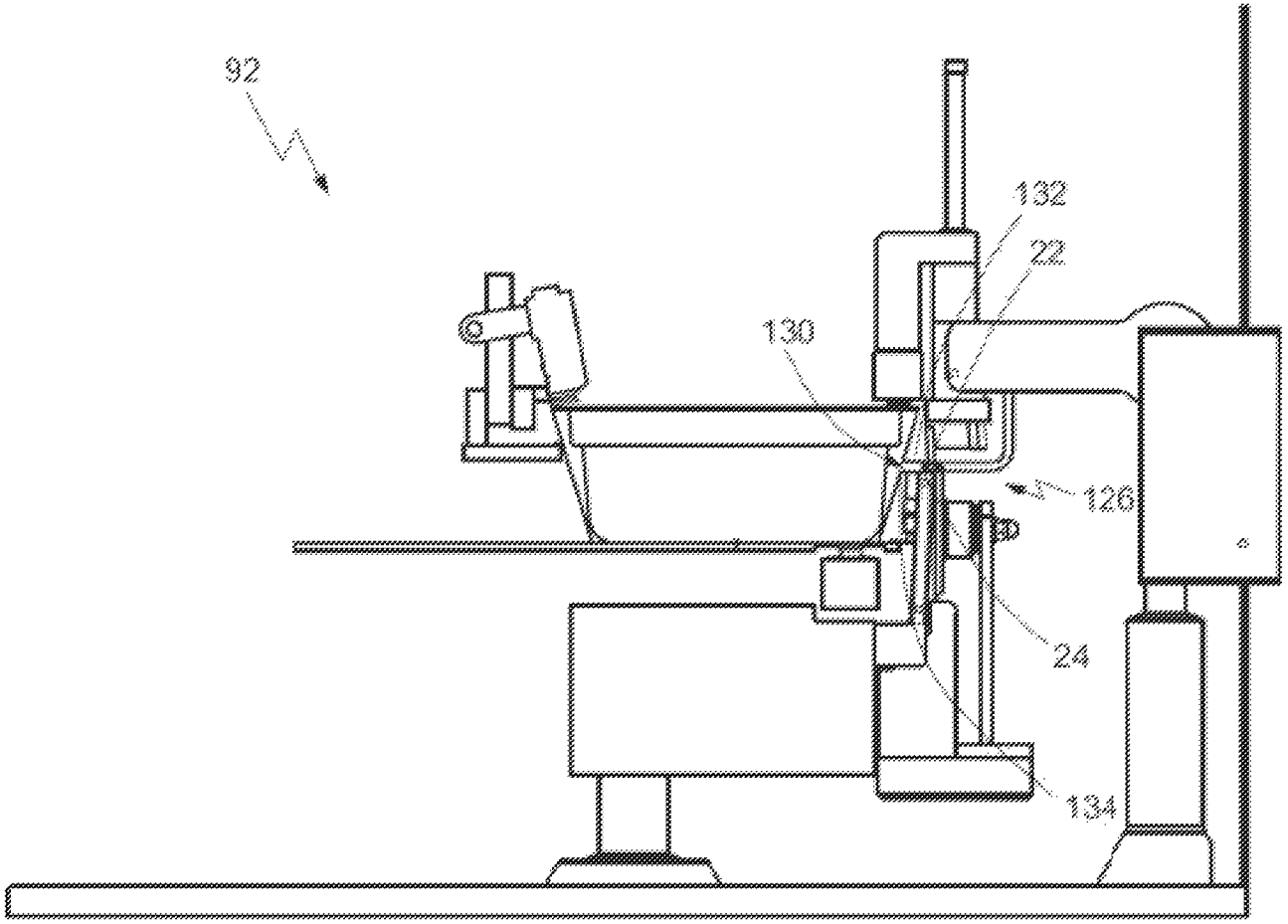
FIG. 11 shows a side view of the apparatus for opening a packaging from FIG. 1 in the step of the second clamping.

FIG. 11 illustrates the apparatus 10 in a state of the step of the second clamping 92 of the method 80. Here, the two clamping elements 22 and 24 are arranged in a fourth position 126. In particular, the first clamping element 22 bears against the first side 132 of the packaging portion 54 and the second clamping element 24 bears against the second side 134 of the packaging portion 54. If the clamping elements have a recess 68 as described in FIG. 3*b*, the fourth position corresponds to the second position. In the fourth position, the blowing nozzle 18 and the second part 58 of the packaging portion 54 are clamped together. In this way, the packaging 52 can be inflated without gas being able to escape from the opening 130.

Figure 12:
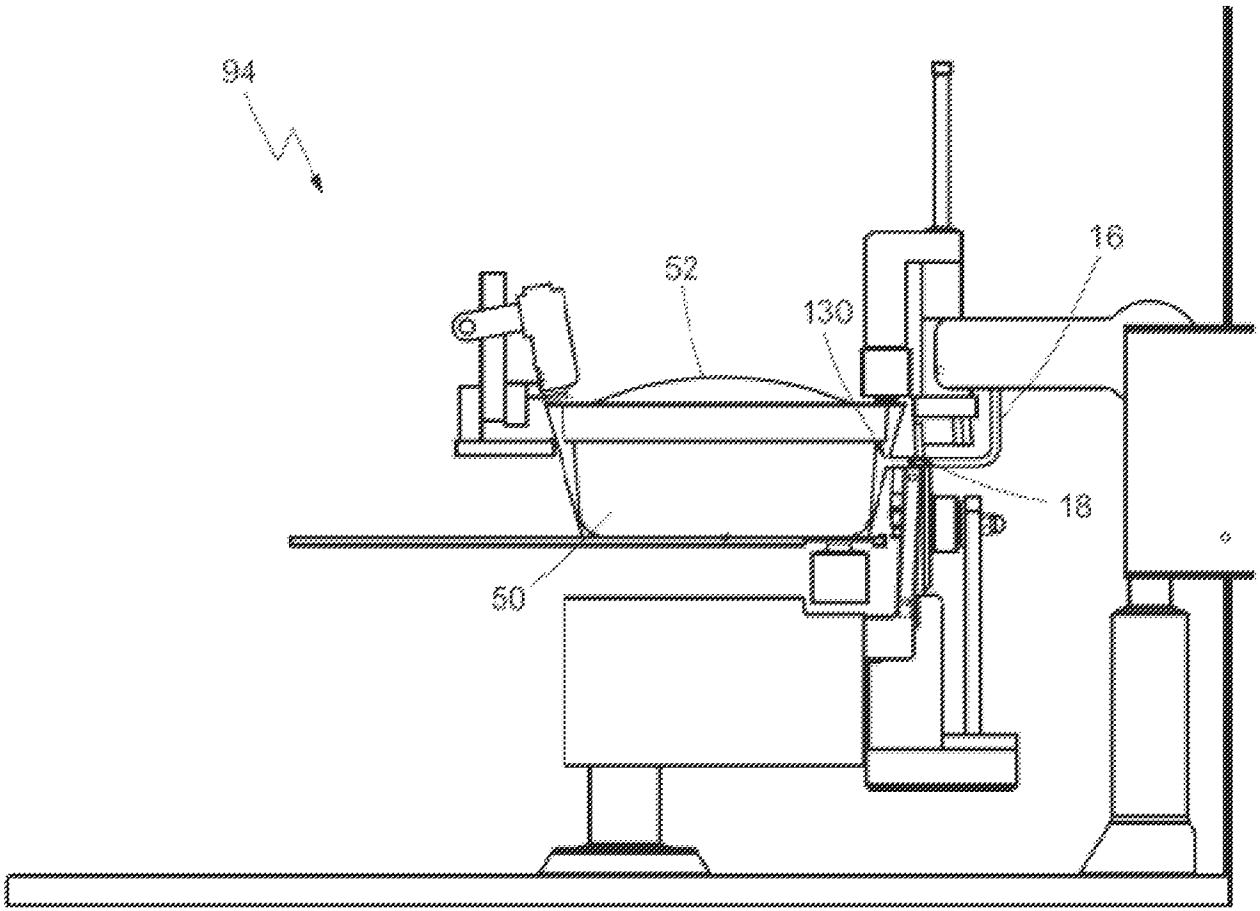
FIG. 12 shows a side view of the apparatus for opening a packaging from FIG. 1 in the step of the inflation.

FIG. 12 illustrates the apparatus 10 in the state of the step of the inflation 94 of the method 80. Here, the packaging 52 is filled with gas by means of the inflating device, such that the packaging at least partially separates from the transport tub 50. In particular, here, the top side of the packaging 52 partially separates from the transport tub 50, as illustrated in FIG. 12 by the arching of the top side.

Figure 13:
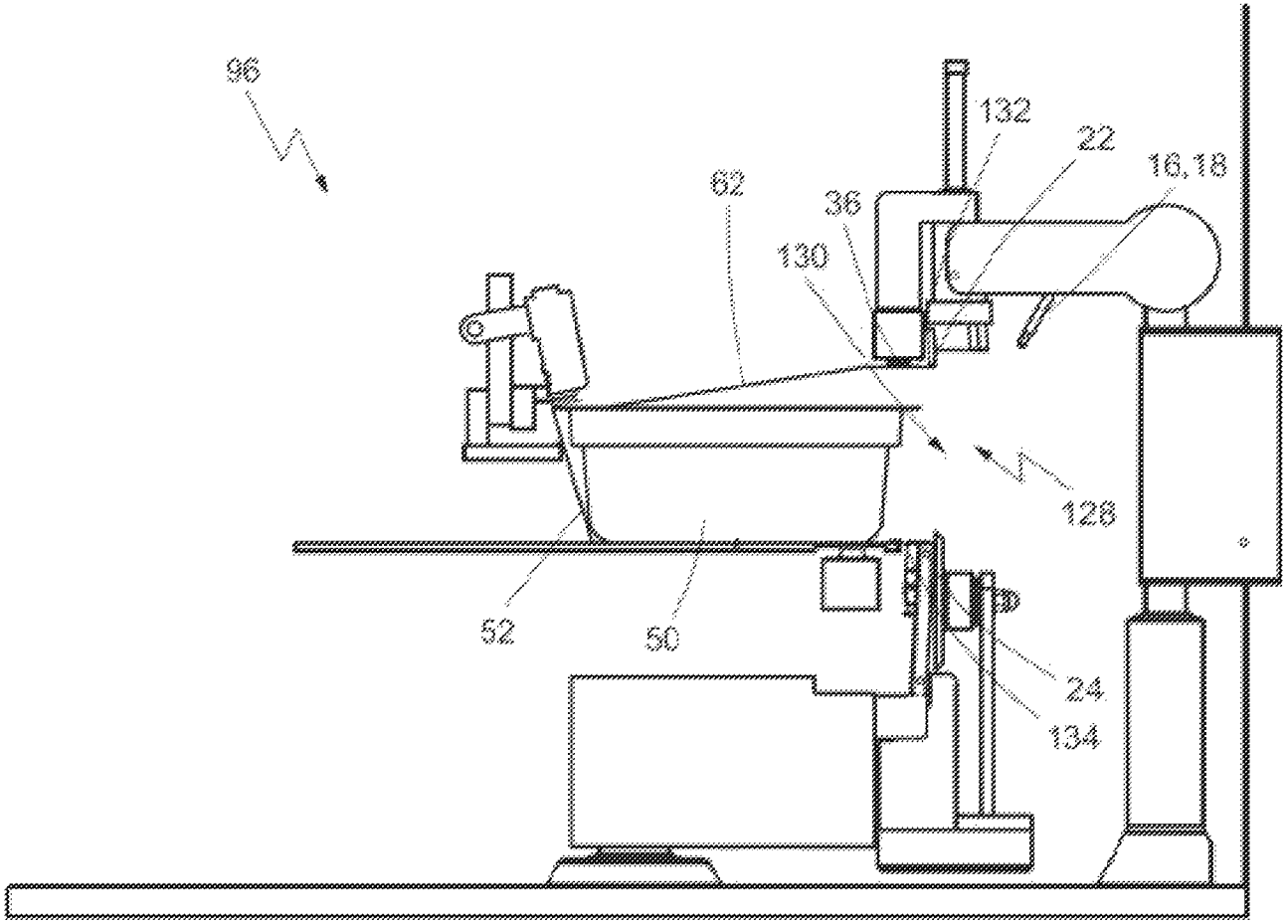
FIG. 13 shows a side view of the apparatus for opening a packaging from FIG. 1 in the step of the second opening.

FIG. 13 illustrates the apparatus 10 in the state of the step of the second opening 96 of the method 80. Here, the first and the second clamping element 22, 24 are arranged in a fifth position 128. In this position, the first and the second clamping element are spaced apart from one another to such an extent that a distance between the first and the second clamping element is greater than the height of the transport tub 50. Here, the first side 132 adheres to the first clamping element 22 and the second side 134 adheres to the second clamping element 24. Additionally, the second fixing element 32 of the fixing device 28 is also moved jointly with the first clamping element 22 in the lifting direction 74 in order to jointly assist the opening at the top side of the packaging 52.

Figure 14:
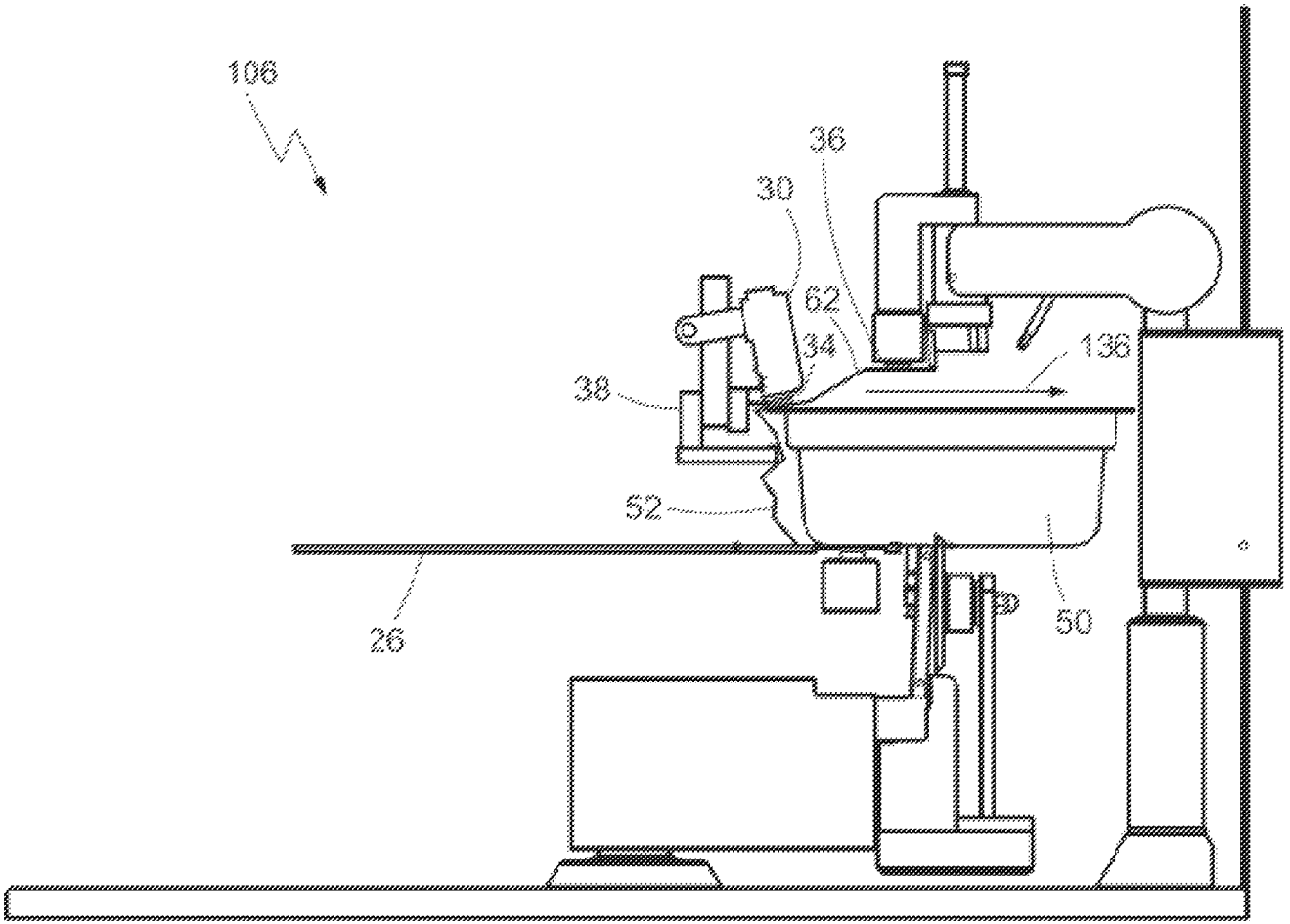
FIG. 14 shows a side view of the apparatus for opening a packaging from FIG. 1 in the step of the pushing-out.

FIG. 14 illustrates the apparatus 10 in the state of the step of the pushing-out 106 of the method 100. Here, the pushing means 38 is moved in a pushing direction 136 which preferably corresponds to the extent direction 70 of the packaging portion 54. The first fixing element 30 and the pushing means 38 are coupled to one another in order to correspondingly guide the top side of the packaging 52.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An apparatus for opening a packaging in which a transport tub for objects is packaged, the packaging having a packaging portion which extends in an extent direction away from the transport tub, wherein the apparatus has a cutting-open device for cutting open the packaging in order to generate an opening in the packaging, the cutting-open device being designed to cut off a first part of the packaging portion in order to generate the opening in the packaging, and has an inflating device for inflating the packaging through the opening generated in the packaging.

2. The apparatus as claimed in claim 1, wherein the packaging portion is arranged at a side of the transport tub, such that the opening is generated on the side of the transport tub.

3. The apparatus as claimed in claim 1, wherein the packaging portion has a second part which is arranged between the first part and the rest of the packaging, a cut generated during the cutting-off of the first part of the packaging portion running between the first part and the second part.

4. The apparatus as claimed in claim 3, wherein the cut runs over the entire width of the packaging portion, the width of the packaging portion extending perpendicular to the extent direction, a cut direction of the cut running perpendicular to the extent direction.

5. The apparatus as claimed in claim 1, wherein the apparatus has a holding device for holding a second part of the packaging portion, the first part and the second part differing from one another.

6. The apparatus as claimed in claim 5, wherein the holding device has a first clamping element and a second clamping element for clamping the second part of the packaging portion, the first clamping element and the second clamping element being movable relative to one another, the first clamping element and the second clamping element being designed to clamp the second part of the packaging portion over the entire width of the packaging portion.

7. The apparatus as claimed in claim 6, wherein adhesion means are provided on that side of each clamping element which faces toward the packaging portion, which adhesion means are designed to adhere to the second part of the packaging portion, to draw the second part of the packaging portion onto them by suction.

8. The apparatus as claimed in claim 5, wherein the holding device is furthermore designed to clamp the second part of the packaging portion during at least one of the cutting-open of the packaging or the inflation of the packaging.

9. The apparatus as claimed in claim 5, wherein the holding device is furthermore designed to widen the opening at least one of before the inflation of the packaging or after the inflation of the packaging.

10. An apparatus for opening a packaging in which a transport tub for objects is packaged, the packaging having a packaging portion which extends in an extent direction away from the transport tub, wherein the apparatus has a cutting-open device for cutting open the packaging in order to generate an opening in the packaging, the cutting-open device being designed to cut off a first part of the packaging portion in order to generate the opening in the packaging, and has an inflating device for inflating the packaging through the opening generated in the packaging, wherein the inflating device has a blowing nozzle which, in order to inflate the packaging, can be inserted into the packaging through the opening of the packaging.

11. The apparatus as claimed in claim 10, wherein the holding device is furthermore designed to clamp the second part of the packaging portion and the blowing nozzle during the inflation of the packaging.

12. The apparatus as claimed in claim 11, wherein at least one of a first clamping element or a second clamping element has a recess for the blowing nozzle, the recess being filled with an elastic material.

13. The apparatus as claimed in claim 1, wherein the apparatus furthermore has a fixing device, the fixing device being designed to fix the packaging and the transport tub at least one of during the cutting-open or during the inflation.

14. The apparatus as claimed in claim 13, wherein the fixing device is furthermore designed to likewise widen the opening after the inflation of the packaging.

15. A system for opening a packaging in which a transport tub for objects is packaged, the packaging having a packaging portion which extends in an extent direction away from the transport tub, wherein the system comprises an apparatus that has a cutting-open device for cutting open the packaging in order to generate an opening in the packaging, the cutting-open device being designed to cut off a first part of the packaging portion in order to generate the opening in the packaging, and has an inflating device for inflating the packaging through the opening generated in the packaging.

16. The system as claimed in claim 15, wherein the apparatus furthermore has a pushing means which is designed to push out the transport tub from the packaging after the opening of the packaging.

17. The system as claimed in claim 15, wherein the system furthermore has a removal device for removing the transport tub from the opened packaging.

18. The system as claimed in claim 15, wherein the system furthermore has a transport device for at least one of transporting in the packaged transport tub or transporting out the unpacked transport tub.

19. A method for opening a packaging in which a transport tub for objects is packaged, wherein the method has the following steps:

providing the packaged transport tub, the packaging having a packaging portion which extends in an extent direction away from the transport tub;

cutting-open of the packaging by means of a cutting-open device in order to generate an opening in the packaging, the cutting-open device cutting off a first part of the packaging portion in order to generate the opening in the packaging; and inflating of the packaging by means of an inflating device through the opening generated in the packaging.

20. The method as claimed in claim 19, wherein the method furthermore has the following step:

inserting of a blowing nozzle of the inflating device into the packaging through the opening of the packaging.

21. The method as claimed in claim 19, wherein the method furthermore has the following step:

first clamping of a second part of the packaging portion by means of a holding device at least during the cutting-off.

22. The method as claimed in claim 19, wherein the method furthermore has the following step:

first opening of the opening of the packaging by means of a holding device after the cutting-off and before the step of inflating.

23. The method as claimed in claim 19, wherein the method furthermore has the following step:

second clamping of a second part of the packaging portion by means of a holding device at least during the inflation.

24. The method as claimed in claim 19, wherein the method furthermore has the following step:

second opening of the opening of the packaging by means of a holding device after the inflation.

25. A method for unpacking a transport tub for objects from a packaging in which the transport tub is packaged, the method having the following steps:

providing of the packaged transport tub, the packaging having a packaging portion which extends in an extent direction away from the transport tub;

cutting-open of the packaging by means of a cutting-open device in order to generate an opening in the packaging, the cutting-open device cutting off a first part of the packaging portion in order to generate the opening in the packaging;

inflating of the packaging by means of an inflating device through the opening generated in the packaging; and at least one of removing the transport tub from the packaging by means of a removal device or pushing-out of the transport tub from the packaging by means of a pushing means.

* * * * *